US009386377B2

(12) United States Patent
Xiao et al.

(10) Patent No.: US 9,386,377 B2
(45) Date of Patent: Jul. 5, 2016

(54) MAGNETIC ASSEMBLY AND ELECTRO-ACOUSTIC TRANSDUCER USING SAME

(71) Applicants: Bo Xiao, Shenzhen (CN); Ronglin Linghu, Shenzhen (CN); Jinquan Huang, Shenzhen (CN)

(72) Inventors: Bo Xiao, Shenzhen (CN); Ronglin Linghu, Shenzhen (CN); Jinquan Huang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 4 days.

(21) Appl. No.: 14/595,334

(22) Filed: Jan. 13, 2015

(65) Prior Publication Data

US 2016/0112804 A1 Apr. 21, 2016

(30) Foreign Application Priority Data

Oct. 20, 2014 (CN) ..... 2014 2 0608037 U

(51) Int. Cl.
*H04R 1/02* (2006.01)
*H04R 9/02* (2006.01)
*H01F 7/02* (2006.01)

(52) U.S. Cl.
CPC ..... *H04R 9/025* (2013.01); *H01F 7/0289* (2013.01)

(58) Field of Classification Search
CPC ..... H04R 7/04; H04R 9/027; H04R 9/04; H04R 9/025; H01F 7/0289
See application file for complete search history.

(56) References Cited

U.S. PATENT DOCUMENTS

2015/0086066 A1* 3/2015 Yan ..... H04R 9/025 381/412
2015/0117699 A1* 4/2015 Cai ..... H01F 7/0289 381/412
2015/0163597 A1* 6/2015 Meng ..... H04R 9/025 381/412

* cited by examiner

*Primary Examiner* — Tuan D Nguyen
(74) *Attorney, Agent, or Firm* — IPro, PLLC; Na Xu

(57) ABSTRACT

An magnetic assembly and an electro-acoustic transducer using the same are disclosed. The magnetic assembly includes a lower plate, a main magnet positioned on a central portion of the lower plate, an auxiliary magnet positioned on a periphery portion of the lower plate, surrounding the main magnet with space, and having an inner surface facing the main magnet and an outer surface opposite to the inner surface, and a first pole plate. The first pole plate includes a base body attached on the auxiliary magnet, and a magnetic conduction member connected with the base body and overlapping the outer surface of the auxiliary magnet for forming a loop of magnetic flux together with the base body and the lower plate as well as the auxiliary magnet.

19 Claims, 6 Drawing Sheets

MAGNETIC ASSEMBLY AND ELECTRO-ACOUSTIC TRANSDUCER USING SAME

FIELD OF THE INVENTION

The present invention relates to the art of electro-acoustic transducers, more particularly to a speaker having an improved magnetic assembly.

DESCRIPTION OF RELATED ART

With the rapid development of wireless communication technologies, portable electronic devices are widely used. Users require portable electronic devices to not only have voice function, but also have high quality acoustic performance. A portable electronic device also provides the users with entertainment contents, such as music, video, game, and so on. For converting electrical signals into audible sounds, a speaker is a necessary component used in the portable electronic device for generating sounds. With the portable electronic device, such as a mobile phone, designed to be smaller and smaller, the speaker used therein is also required to have a low profile with small size.

An electro-acoustic transducer related to the present disclosure includes an vibration unit and a magnetic assembly for driving the vibration unit to vibrate. The magnetic assembly includes a lower plate, a main magnet positioned on a central portion of the lower plate, a pair of auxiliary magnets positioned away from two sides of the main magnet and a pair of second pole plates attached on upper surfaces of the auxiliary magnets, respectively. A magnetic gap is accordingly formed between the main magnet and the auxiliary magnets for partially receiving a voice coil. The magnets, including the main magnet and the auxiliary magnets, are all attached to the lower plate by adhesive, or soldering. Therefore, with such configuration of the magnetic assembly, a magnetic flux leakage would occur at the sides of the auxiliary magnets away from the main magnet, which will badly affect the acoustic performance of the electro-acoustic transducer.

Therefore, it is desirable to provide an improved magnetic assembly which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Figure 1:
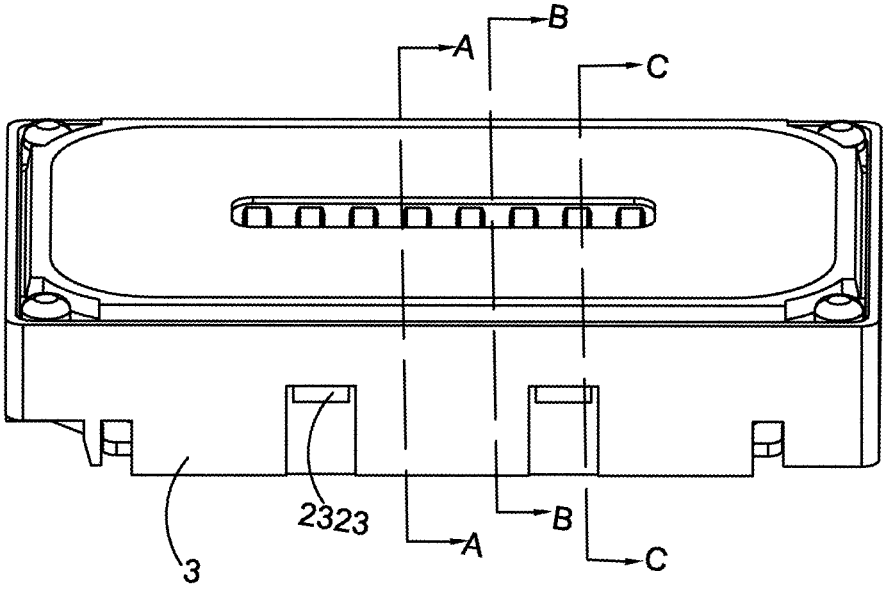
FIG. 1 is an illustrative isometric view of an electro-acoustic transducer according to an exemplary embodiment of the present invention.
Figure 2:
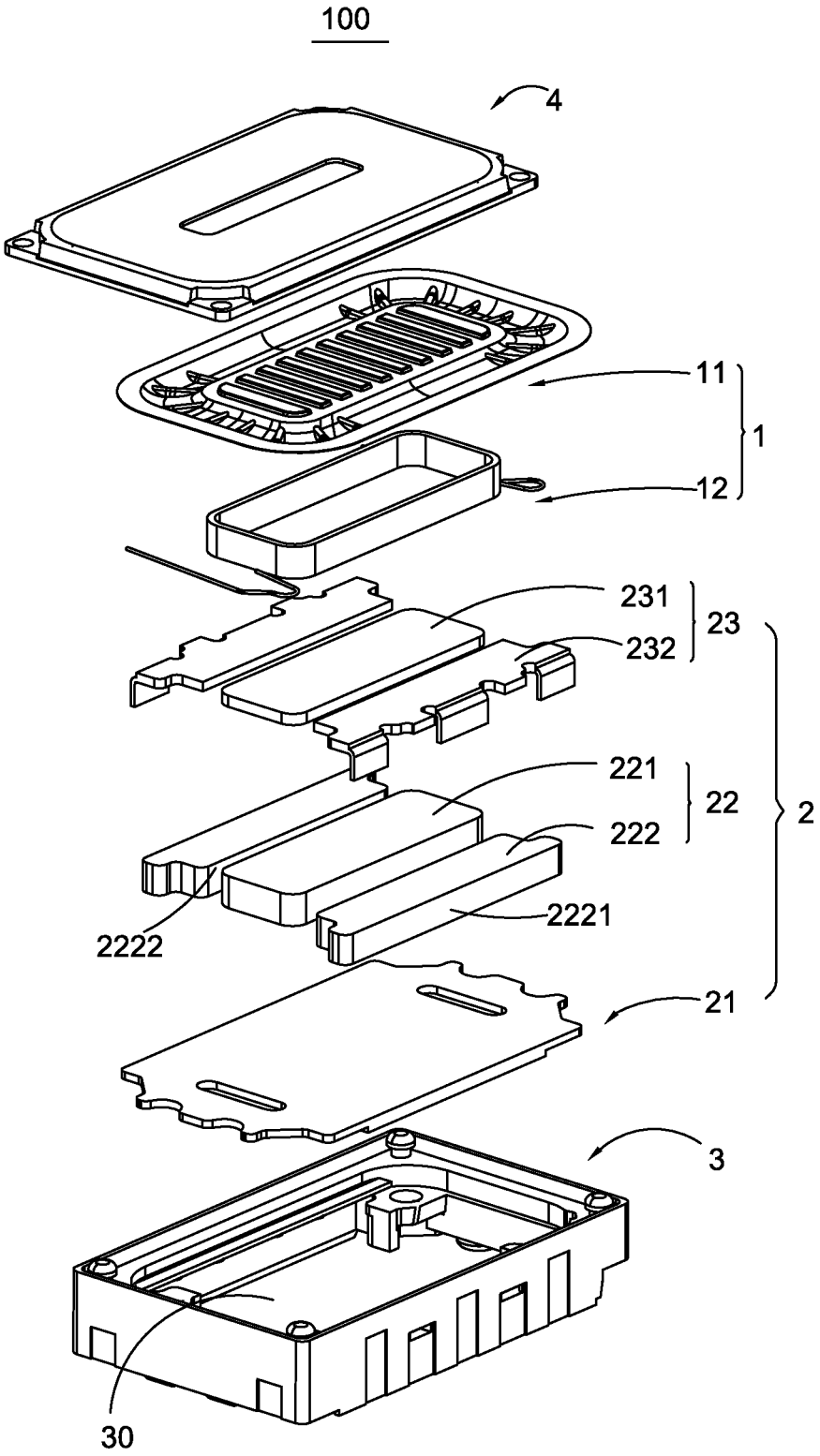
FIG. 2 is an exploded view of the electro-acoustic transducer in FIG. 1.

Referring to FIG. 1 and FIG. 2, an electro-acoustic transducer 100 according to an exemplary embodiment comprises a frame 3, a magnetic assembly 2 accommodated in the frame 3, a vibration unit 1 fixed to the frame 3 and driven to vibrate along a vibration direction by the magnetic assembly 2, and a cover 4 pressing a periphery of the vibration unit 1 to the frame 3 for fixing the vibration unit 1 to the frame. In an alternative embodiment, the vibration unit 1 could also be fixed to the magnetic assembly 2.

The vibration unit (comprises a diaphragm 11 and a voice coil 12 connected with the diaphragm 11 for driving the diaphragm 11 to vibrate. Optionally, the voice coil 12 may be connected to the diaphragm 11 via a medium which is directly connected with the diaphragm 11. In other words, the voice coil 12 may be connected to the diaphragm 11 directly or indirectly. Therefore, the term "connect" here means to connect something to another via a medium or to connect something to another directly without any medium.

Figure 3:
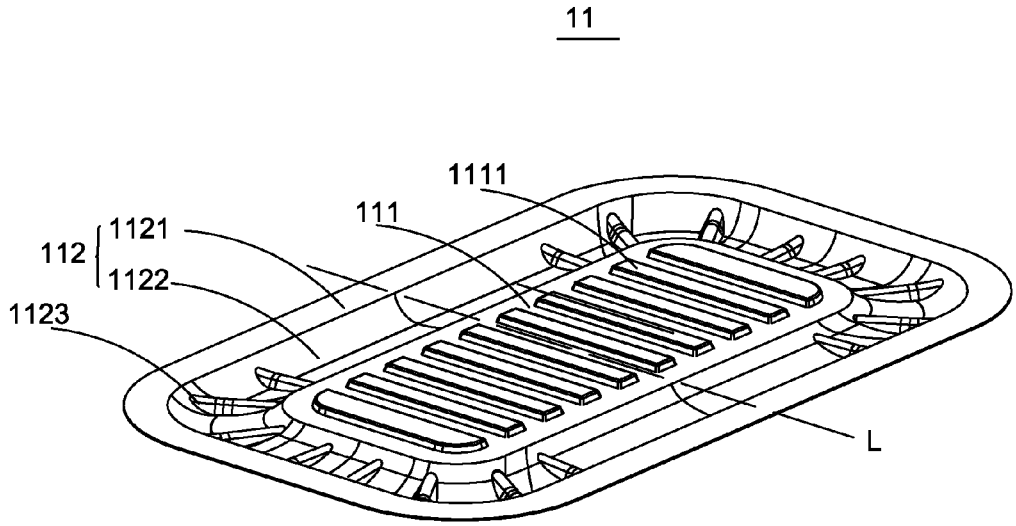
FIG. 3 is an illustrative isometric view of a diaphragm of the electro-acoustic transducer in FIG. 2.
Figure 4:
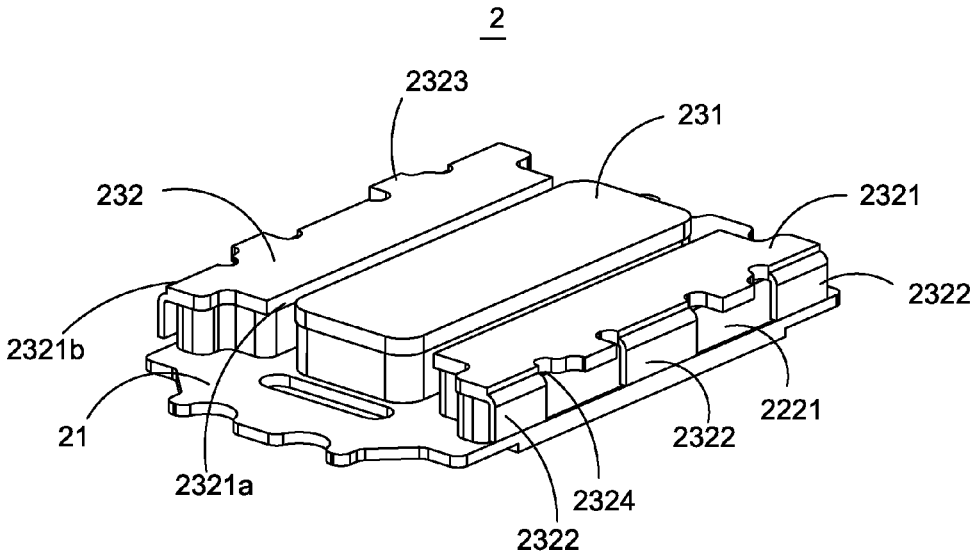
FIG. 4 is an illustrative isometric view of a magnetic assembly of the electro-acoustic transducer in FIG. 2.
Figure 5:
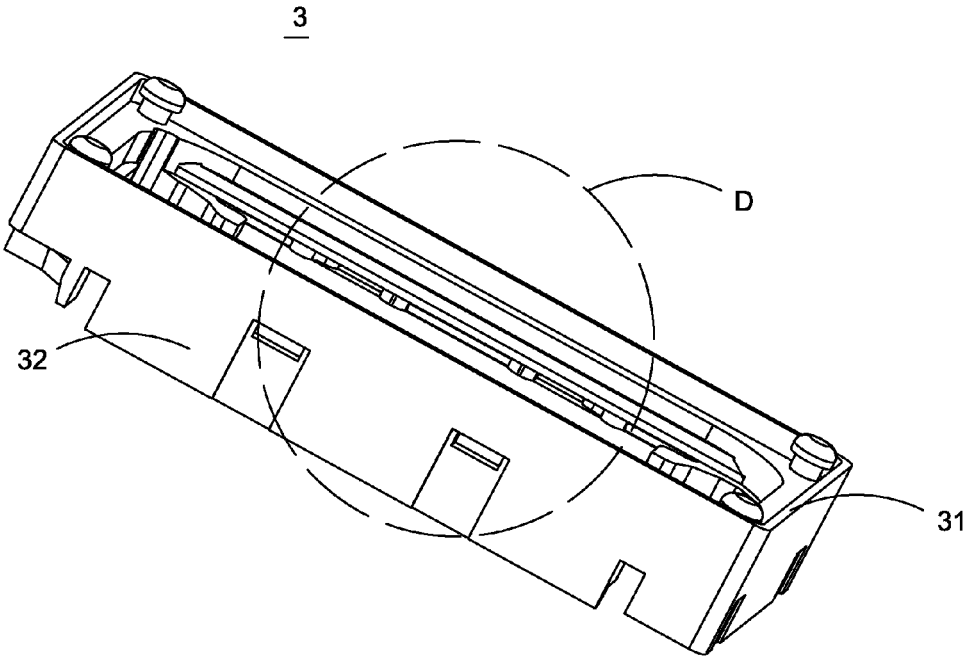
FIG. 5 is an illustrative isometric view of a frame of the electro-acoustic transducer in FIG. 2.
Figure 6:
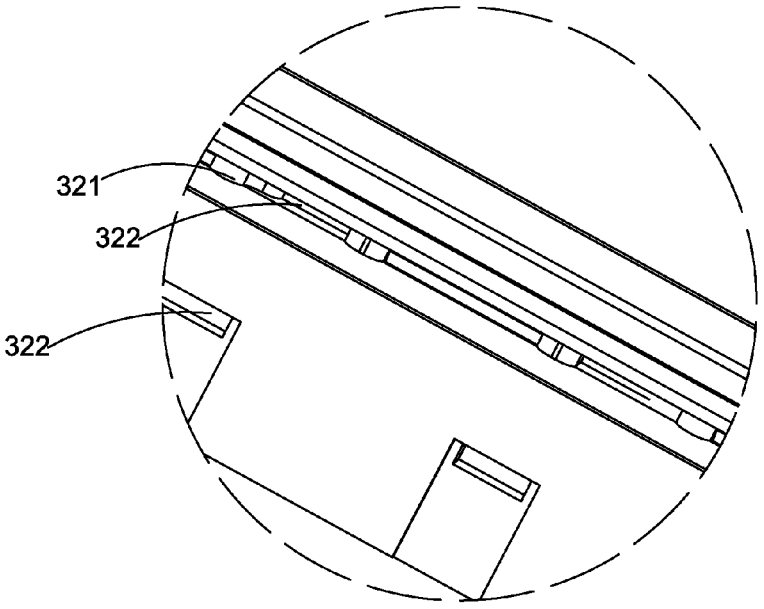
FIG. 6 is an enlarged view of circled part D of FIG. 5.
Figure 7:
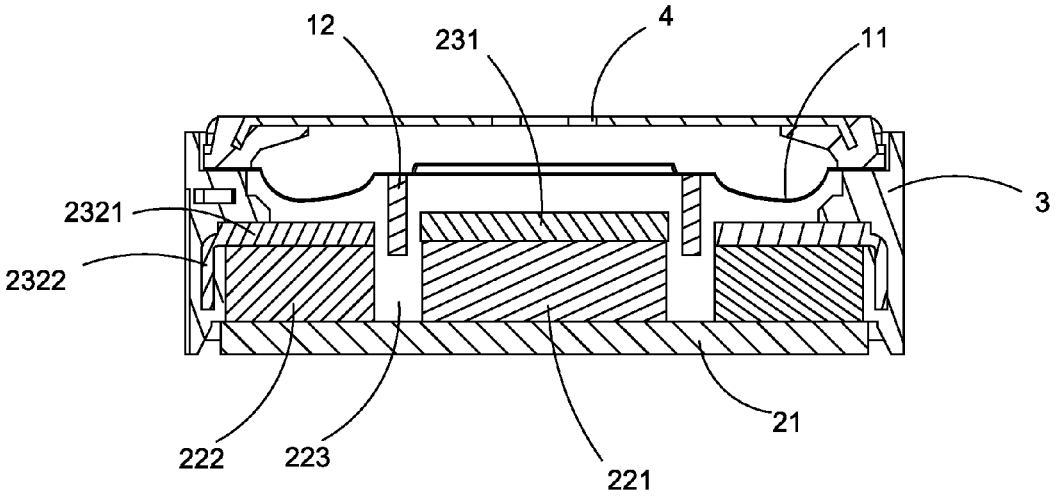
FIG. 7 is a cross-sectional view of the electro-acoustic transducer taken along line A-A in FIG. 1.
Figure 8:
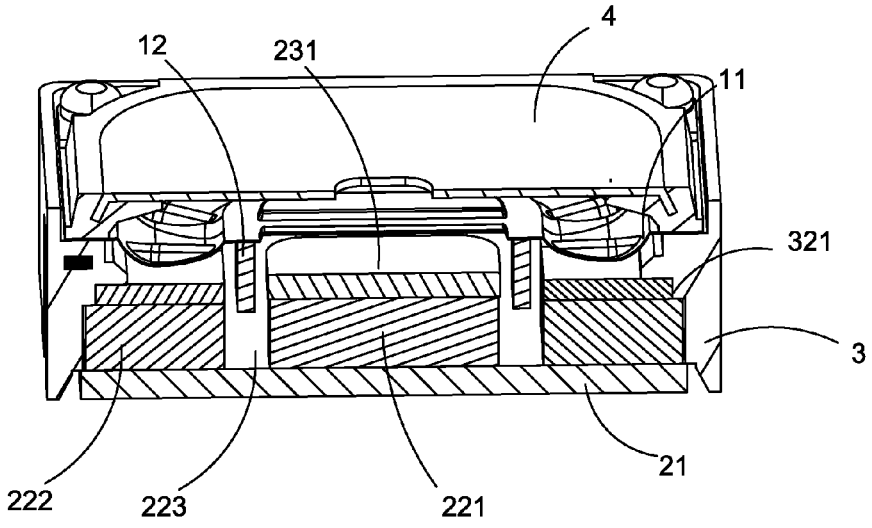
FIG. 8 is a cross-sectional view of the electro-acoustic transducer taken along line B-B in FIG. 1.
Figure 9:
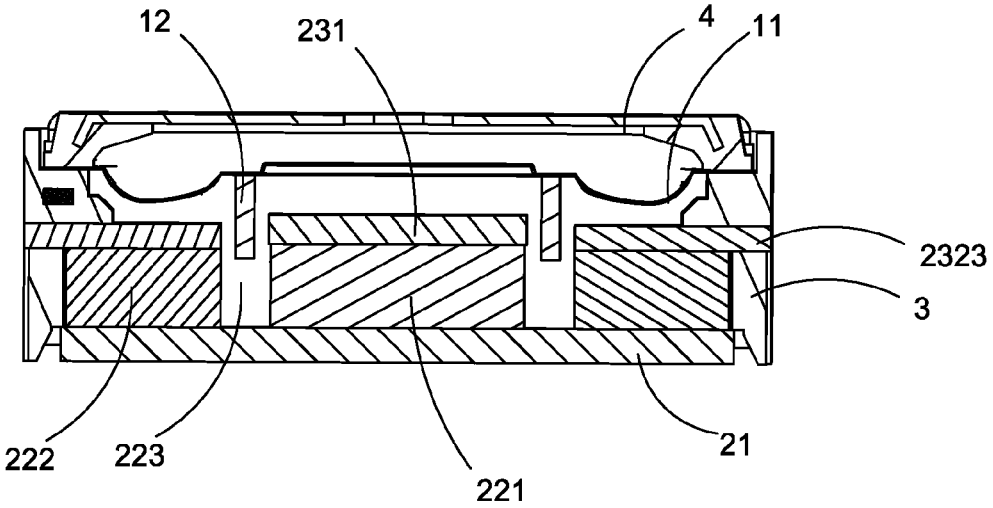
FIG. 9 is a cross-sectional view of the electro-acoustic transducer taken along line C-C in FIG. 1.

Referring to FIG. 3, The diaphragm 11 is made from stretchable and soft material. The diaphragm 11 takes a rectangular shape and defines a center line L. The diaphragm 11 includes a dome 111 and a suspension 112 connected with the dome 111 and surrounding the dome 111, both of which are optionally symmetrical with respect to the center line L. The suspension 112 includes a ring edge 1121 assembled with the frame 3 and a supporting part 1122 connected with the dome 111 for supporting the dome 111. The supporting part 1122 has groups of corrugations 1123 located on two sides of the supporting part 1122 parallel to the center line L and spaced with each other for increasing structural strength of the suspension. A plurality of long ribs 1111 is provided on the top face of the dome 111. The long ribs 1111 each extending parallel to the center line L are arranged in a direction perpendicular to the center line L and spaced with each other in an uniform interval, which can increase structural strength of the dome 111.

Referring to FIGS. 4 and 7-9, the magnetic assembly 2 comprises a base plate 21, a main magnet 221 disposed on a center portion of the base plate 21, and an auxiliary magnets 222 disposed on a periphery portion of the base plate 21 for forming a magnetic gap 223 together with the main magnet 221. In this embodiment, two separated auxiliary magnets 222 are provided to surround the main magnet 221. Alternatively, four separated auxiliary magnets 222 may be provided. In other embodiment, the amount of the auxiliary magnets 222 is variable corresponding to actual requirements. The voice coil 12 has one end accommodated in the magnetic gap 223 and the other end connected with the diaphragm 11.

The base plate 21 is made of magnetic conduction materials for effectively conducting magnetic fluxes. At least one of the main magnet and auxiliary magnet 221, 222 is a permanent magnet. In this embodiment, both the main magnet 221 and the auxiliary magnet 222 are permanent magnets. In an alternative embodiment, the main magnet is a permanent magnet and the auxiliary magnet is made of magnetic conduction materials for effectively conducting magnetic fluxes. Furthermore, the auxiliary magnet and the base plate may be integrally formed as one unit. Or, the main magnet is made of magnetic conduction materials for effectively conducting magnetic fluxes and the auxiliary magnets are permanent magnets. The main magnet and the base plate may be integrally formed as one unit. In this embodiment, the auxiliary magnet 222 takes a cuboid shape, and comprises an inner surface 2222 facing the main magnet 221, and an outer surface 2221 opposite to the inner surface 2222.

The magnetic assembly 2 further comprises a first pole plate 232 attached on top face of the auxiliary magnet 222 and a second pole plate 231 attached on a top face of the main magnet 221. In this embodiment, two separated first pole plates 232 are provided to cover the auxiliary magnets respectively. The first pole plate 232 has a top face being coplanar with that of the second pole plate 231 thereby providing a greater vibration space to the diaphragm 11. While electrified, the voice coil 12 drives the diaphragm 11 to vibrate along the vibration direction by the interaction between the voice coil 12 and the magnetic assembly 2. Generally, the vibration direction is perpendicular to the base plate 21.

In this embodiment, each first pole plate 232 includes a base body 2321 attached on the top face of the auxiliary magnet 222 and a magnetic conduction member 2322 connected with the base body 2321 and overlapping the outer surface 2221 of the auxiliary magnet 222 for forming a loop of magnetic flux together with the base body 2321 and the lower plate 21 as well as the auxiliary magnet 222 so as to reduce the amount of magnetic flux leakage of the magnetic assembly that occurs at the outer surface 2221 of the auxiliary magnet 222. The base body 2321 and the magnetic conduction member 2322 are made of magnetic conduction materials for effectively conducting magnetic fluxes.

In this embodiment, the base body 2321 takes a rectangular shape, which is shaped to match that of the auxiliary magnets 222. The base body 2321 includes a first side 2321*a* facing the main magnet 221 and a second side 2321*b* opposite to the first side 2321*a*. The magnetic conduction member 2322 includes three separated magnetic conduction parts 2322 each extending substantially perpendicularly from the second side 2321*b* substantially to the lower plate 21 so as to be close to the lower plate 21. Three separated magnetic conduction parts 2322 are spaced with each other. Optionally, one of the magnetic conduction parts 2322 locates in the central portion of the second side 2321*b*, and the other two magnetic conduction part 2322 locates in the both ends of the second side 2321*b* respectively. Each magnetic conduction part 2322 is a flat plate, parallel to the outer surface 2221 of the auxiliary magnet 222 with space and positioned outside the outer surface 2221 of the auxiliary magnet 222. A bottom surface of the magnetic conduction part 2322 may be in contact with the lower plate 21. Alternatively, the bottom surface of the magnetic conduction part 2322 may be close to the lower plate 21 as far as possible. The number of magnetic conduction parts 2322 is not limited to this, and is variable according to actual requirements. Alternatively, the magnetic conduction part may be separated element which is connected to the base body by gluing, soldering, or the like.

In this embodiment, the first pole plate 232 further comprises a plurality of connecting parts 2323 each locating between two adjacent magnetic conduction parts 2322 and extending substantially horizontally from the second side 2321*b* in a direction away from the first side 2321*a*. Each connecting part 2323 is configured for connecting to the frame 3. Optionally, the connecting part 2323 is integrated with the frame 3 by insert-molding.

The first pole plate 232 defines a plurality of recesses 2324 each formed on the second side 2321*b* and located between the connecting part 2323 and the magnetic conduction part 2322. Each recess 2324 is depressed from the second side 2321*b* toward the first side 2321*a*.

Referring to FIG. 5 through FIG. 9 and FIG. 2, the frame 3 includes a pair of first sidewalls 31 arranged opposite to each other and a pair of second sidewalls 32 arranged opposite to each other. Each first sidewall 31 is adjacent to each second sidewall 32. The first and second sidewalls 31,32 are connected with each other one by one, in order from a beginning to an end, to form a receiving space 30. In this embodiment, each second sidewall 32 faces the second side 2321*b* of the first pole plate 232. Each second sidewall 32 defines a plurality of engaging grooves 322 corresponding to the connecting parts 2323 one by one for receiving the connecting part 2323. Each second sidewall 32 further comprises a plurality of projections 321 corresponding to the recesses 2324 one by one for inserting into the recesses 2324. While assembled, the magnetic assembly 2 is received in the receiving space 30. The connecting part 2323 is received in the engaging groove 322, the projection 321 is received in the recess 2324 and the magnetic conduction part 2322 is embedded into the second sidewall 32 of the frame 3. By virtue of the configuration of the frame 3, the first pole plate 232 can be fixed to the frame 3 firmly.

It is to be understood, however, that even though numerous characteristics and advantages of the present disclosure have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A magnetic assembly, comprising:

a lower plate;

a main magnet positioned on a central portion of the lower plate;

an auxiliary magnet positioned on a periphery portion of the lower plate, surrounding the main magnet with space, and having an inner surface facing the main magnet and an outer surface opposite to the inner surface;

a first pole plate including a base body attached on the auxiliary magnet, and a magnetic conduction member connected with the base body and overlapping the outer surface of the auxiliary magnet for forming a loop of magnetic flux together with the base body and the lower plate as well as the auxiliary magnet.

2. The magnetic assembly of claim 1, wherein, the base body comprises a first side facing the main magnet and a second side opposite to the first side;

the magnetic conduction member is connected with the second side of the base body.

3. The magnetic assembly of claim 2, wherein, the magnetic conduction member comprises a plurality of magnetic conduction parts each extending substantially perpendicularly from the second side of the base body toward the lower plate and spaced with each other.

4. The magnetic assembly of claim 3 further comprises a frame having a receiving space for receiving the magnetic assembly; and wherein the first pole plate further comprises a plurality of connecting parts each disposed between each two adjacent magnetic conduction parts for connecting with the frame.

5. The magnetic assembly of claim 4, wherein each connecting part protrudes substantially horizontally from the second side in a direction away from the first side and integrated with the frame.

6. The magnetic assembly of claim 5, wherein the frame has a plurality of engaging grooves corresponding to the connecting parts one by one for receiving the connecting part.

7. The magnetic assembly of claim 6, wherein the first pole plate further defines a plurality of recesses each formed on the second side and located between the connecting part and the magnetic conduction part.

8. The magnetic assembly of claim 7, wherein the frame further comprises a plurality of projections corresponding to the recesses one by one for inserting into the recess.

9. An electro-acoustic transducer, comprising, a frame having a receiving space;

a magnetic assembly received in the receiving space and including:

a lower plate;

a main magnet positioned on a central portion of the lower plate;

an auxiliary magnet positioned on a periphery portion of the lower plate, surrounding the main magnet with space for forming a magnetic gap, and having an inner surface facing the main magnet and an outer surface opposite to the inner surface;

a first pole plate including a base body attached on the auxiliary magnet, and a magnetic conduction member connected with the base body and overlapping the outer surface of the auxiliary magnet for forming a loop of magnetic flux together with the base body and the lower plate as well as the auxiliary magnet; and a second pole plate attached on the main magnet; and a diaphragm assembled with the frame and vibrating along a vibration direction;

a voice coil connected with the diaphragm and partially received in the magnetic gap.

10. The electro-acoustic transducer of claim 9, wherein, the base body comprises a first side facing the main magnet and a second side opposite to the first side;

the magnetic conduction member is connected with the second side of the base body.

11. The electro-acoustic transducer of claim 10, wherein, the magnetic conduction member comprises a plurality of magnetic conduction parts each extending substantially perpendicularly from the second side of the base body toward the lower plate and spaced with each other.

12. The electro-acoustic transducer of claim 11, wherein the first pole plate further comprises a plurality of connecting parts each disposed between each two adjacent magnetic conduction parts for connecting with the frame.

13. The electro-acoustic transducer of claim 12, wherein each connecting part protrudes substantially horizontally from the second side in a direction away from the first side and integrated with the frame.

14. The electro-acoustic transducer of claim 13, wherein the frame has a plurality of engaging grooves corresponding to the connecting parts one by one for receiving the connecting part.

15. The electro-acoustic transducer of claim 14, wherein the first pole plate further defines a plurality of recesses each formed on the second side and positioned between the connecting part and the magnetic conduction part.

16. The electro-acoustic transducer of claim 15, wherein the frame further comprises a plurality of projections corresponding to the recesses one by one for inserting into the recess.

17. The electro-acoustic transducer of claim 9, wherein the diaphragm defines a center line and comprises a dome and a suspension connected with the dome, both of which are symmetrical with respect to the center line.

18. The electro-acoustic transducer of claim 17, wherein the suspension has groups of corrugations positioned on two sides of the suspension parallel to the center line and spaced with each other.

19. The electro-acoustic transducer of claim 18, wherein the dome has a plurality of ribs each extending parallel to the center line, which are arranged in a direction perpendicular to the center line and spaced with each other in an uniform interval.

* * * * *